US010669761B1

(12) United States Patent
Diaz-Skoff

(10) Patent No.: US 10,669,761 B1
(45) Date of Patent: Jun. 2, 2020

(54) DOOR HINGE

(71) Applicant: Lucciano Diaz-Skoff, San Juan, PR (US)

(72) Inventor: Lucciano Diaz-Skoff, San Juan, PR (US)

( * ) Notice: Subject to any disclaimer, the term of this patent is extended or adjusted under 35 U.S.C. 154(b) by 51 days.

(21) Appl. No.: 16/106,017

(22) Filed: Aug. 21, 2018

Related U.S. Application Data

(60) Provisional application No. 62/549,350, filed on Aug. 23, 2017.

(51) Int. Cl.
*E05D 5/04* (2006.01)
*E05D 11/10* (2006.01)
*E05D 7/12* (2006.01)

(52) U.S. Cl.
CPC ..... *E05D 5/04* (2013.01); *E05D 7/12* (2013.01); *E05D 11/1028* (2013.01); *E05Y 2900/132* (2013.01); *Y10T 16/535* (2015.01)

(58) Field of Classification Search
CPC ... Y10T 16/254; Y10T 16/558; Y10T 16/559; Y10T 16/5595; Y10T 16/55963; Y10T 16/55975; Y10T 16/55988; E05D 5/04; E05D 11/1028; E05D 7/12; E05Y 2900/132
USPC ..... 16/254, 387–392
See application file for complete search history.

(56) References Cited

U.S. PATENT DOCUMENTS 1,536,490 A * 5/1925 Geschickter ..... E05D 3/02 16/257
5,193,308 A * 3/1993 Davidian ..... E05D 5/023 16/257
6,154,926 A * 12/2000 Formiller ..... E05D 5/04 16/382
2014/0150345 A1* 6/2014 Price ..... E05D 3/022 49/381

* cited by examiner

*Primary Examiner* — William L Miller
(74) *Attorney, Agent, or Firm* — Luis Figarella

(57) ABSTRACT

A hinge including two parts, the first part having a folding portion formed by a first leaf having holes and the second leaf having mechanical components for support, the second part formed by a portion having mounting holes and complementary mechanical support components to those in the first part.

4 Claims, 4 Drawing Sheets

DOOR HINGE

CROSS-REFERENCE TO RELATED APPLICATIONS

This application claims priority to U.S. Provisional patent application Ser. No. 62/549,350 titled "Improved Door Hinge", filed on Aug. 23, 2017 the disclosure of which is herein incorporated by reference in its entirety.

PATENTS CITED

The following documents and references are incorporated by reference in their entirety, Davidian (U.S. Pat. No. 5,193,308), Price (U.S. Pat. Pub. No. 2014/0150345), Flaman et al (U.S. Pat. Pub. No. 2013/0007986), Root et al (U.S. Pat. No. RE45,355), Reichel (U.S. Pat. Pub. No. 2011/0099755) and Hodgson (U.S. Pat. No. 5,956,809).

FIELD OF THE INVENTION

The present invention relates to a hinge for vertically hanging a swinging entity, more particularly the present invention relates to a hinge structure to facilitate installation of a door to the door frame by a single individual.

DESCRIPTION OF THE RELATED ART

Hanging a door is usually a two person job, where because the door hinge suffers from a number of well-known problems, they are difficult to install because vertical and angular positioning tolerances on the hinge plate are small. This forces the installation process to usually require two people, one to hold the door, the other to guide and align the connection of the two hinge parts. Hence it is common practice to make pre-hung door assemblies in a factory using jigs or the like wherein alignment is performed under controlled assembly conditions and for the user to purchase such factory made pre-hung doors assemblies. Obviously, such assemblies are comparatively expensive.

A number of different hinge structures have been suggested and patented that attempt to overcome some of these difficulties including accommodating differential warping or some relative displacement of the frame and door or closure member. What is needed, is an easy to engage hinge assembly that allows for the interconnection to be easily to accomplish by a single individual.

SUMMARY OF THE INVENTION

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

In one aspect the invention is about a hinge structure comprising a first and a second part, wherein said first part is comprised of a first and a second leaf whose common ends have a connecting hinge component, said first leaf has one or more through openings, and said second leaf portion has one or more support mechanical components and a second part comprised one or more pieces that has one or more openings and one or more support mechanical components that are complementary to those on said second leaf of said first part. In another aspect, said hinge components are comprised of at least one of the following: knuckle, loop, joint, node, curl or flexible strip and said support mechanical components are comprised of one or more of the following: slots, hooks, awnings, flaps, edges, tabs, flaps or similar supports. In yet another aspect, said second part structure has one or more edge tabs to hold portions of said first hinge structure second leaf. In another aspect, said first part support mechanical components and/or said second part support mechanical components have one or more edge tabs to hold the complementary mechanical support mechanical portions in place. In yet another aspect, said first part support mechanical components and/or said second part support mechanical components have one or more edge tabs to hold the complementary mechanical support mechanical portions in place. In another aspect, said second part structure has one or more edge tabs to hold portions of said first hinge structure second leaf. In yet another aspect, said first part support mechanical components and/or said second part support mechanical components have one or more edge tabs to hold the complementary mechanical support mechanical portions in place.

Other features and advantages of the present invention will become apparent upon examining the following detailed description of an embodiment thereof, taken in conjunction with the attached drawings.

Figure 1:
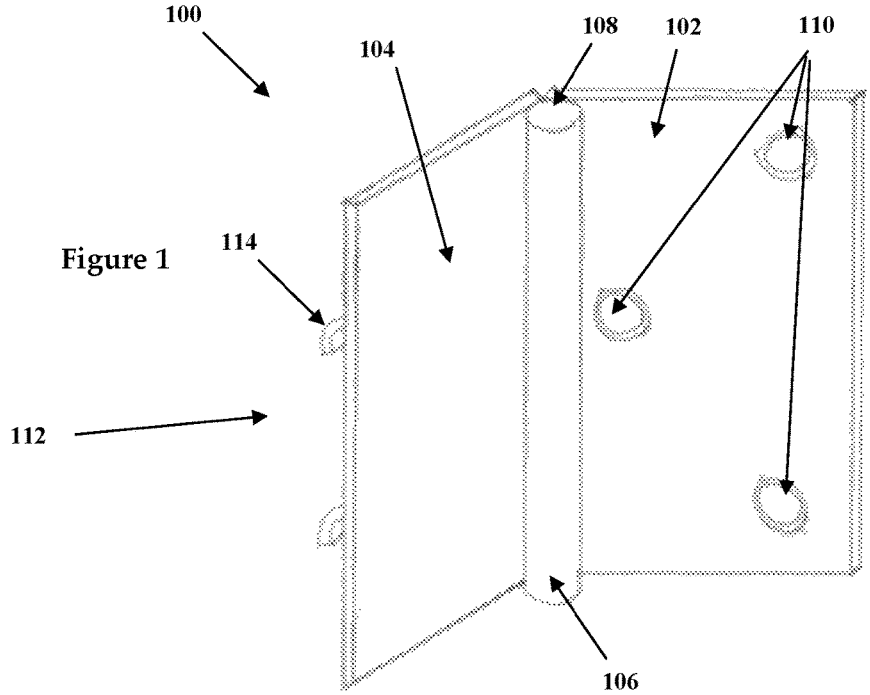
FIG. 1 shows an illustration of the front view of the first part of a proposed improved hinge, according to an exemplary embodiment of the invention.

The above-described and other features will be appreciated and understood by those skilled in the art from the following detailed description, drawings, and appended claims.

DETAILED DESCRIPTION OF THE PREFERRED EMBODIMENT

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

To provide an overall understanding of the invention, certain illustrative embodiments and examples will now be described. However, it will be understood by one of ordinary skill in the art that the same or equivalent functions and sequences may be accomplished by different embodiments that are also intended to be encompassed within the spirit and scope of the disclosure. The compositions, apparatuses, systems and/or methods described herein may be adapted and modified as is appropriate for the application being addressed and that those described herein may be employed in other suitable applications, and that such other additions and modifications will not depart from the scope hereof.

Simplifications or omissions may be made to avoid obscuring the purpose of the section. Such simplifications or omissions are not intended to limit the scope of the present invention. All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

As used in the specification and claims, the singular forms "a", "an" and "the" include plural references unless the context clearly dictates otherwise. For example, the term "a transaction" may include a plurality of transaction unless the context clearly dictates otherwise. As used in the specification and claims, singular names or types referenced include variations within the family of said name unless the context clearly dictates otherwise.

Certain terminology is used in the following description for convenience only and is not limiting. The words "lower," "upper," "bottom," "top," "front," "back," "left," "right" and "sides" designate directions in the drawings to which reference is made, but are not limiting with respect to the orientation in which the modules or any assembly of them may be used.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

Figure 2:
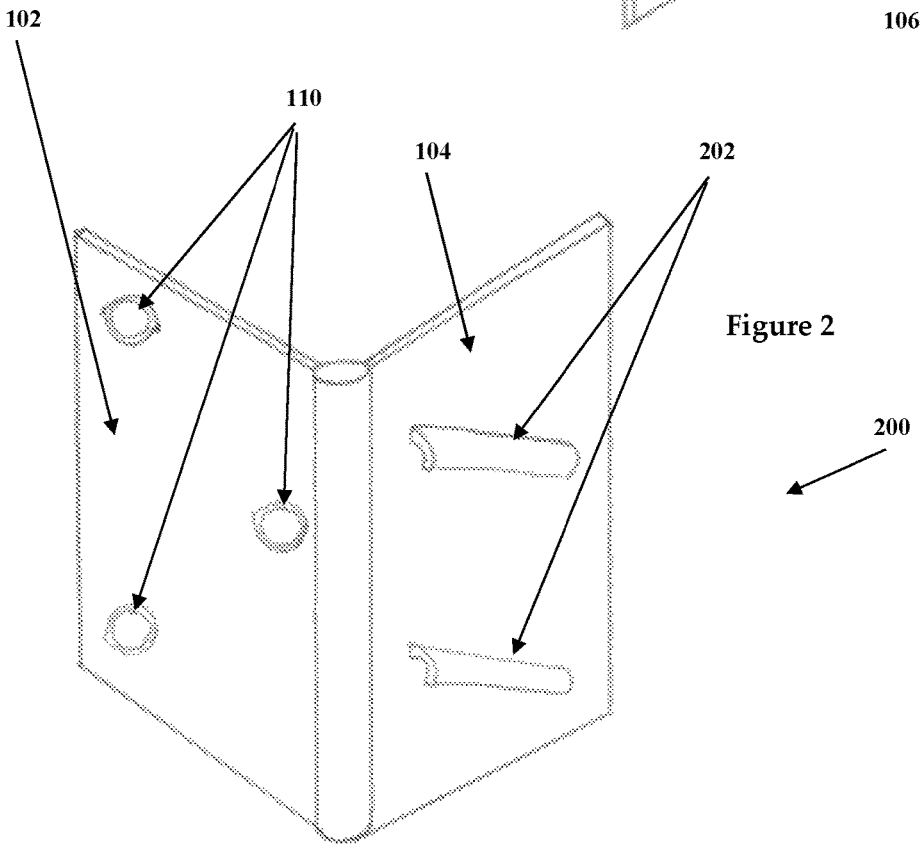
FIG. 2 shows an illustration of the back view of the first part of a proposed improved hinge, according to an exemplary embodiment of the invention.
Figure 3:
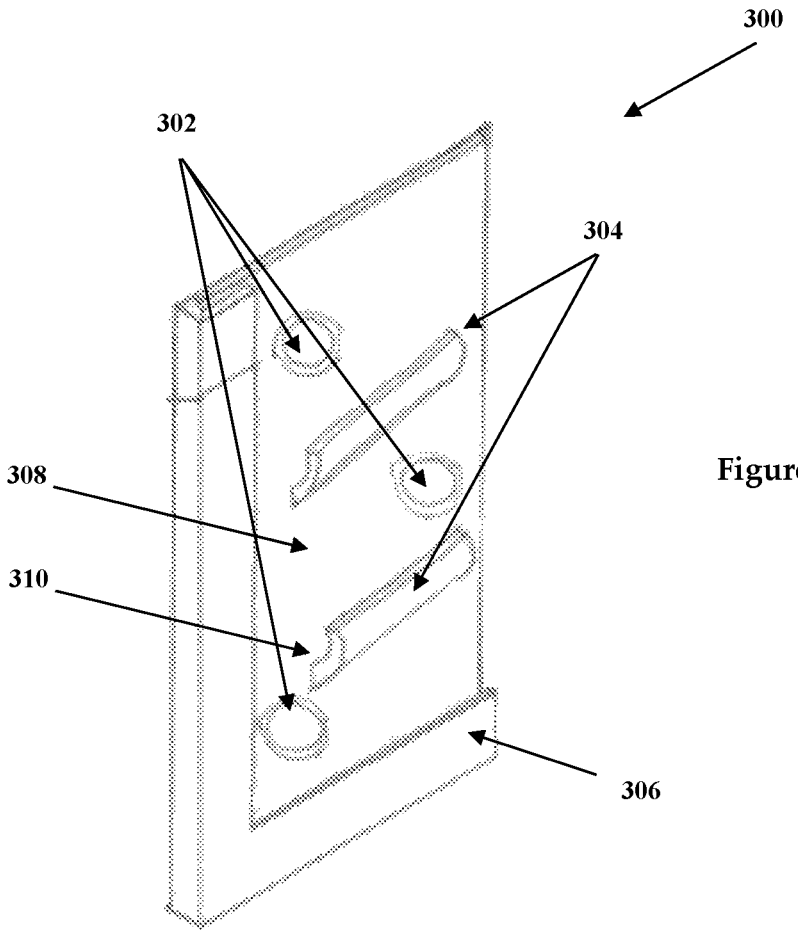
FIG. 3 shows an illustration of the front view of the second part of a proposed improved hinge, according to an exemplary embodiment of the invention.
Figure 4:
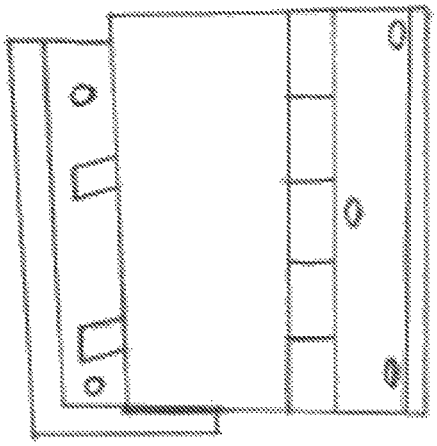
FIG. 4 shows an illustration of one view of the first piece going onto the second part, according to an exemplary embodiment of the invention.
Figure 5:
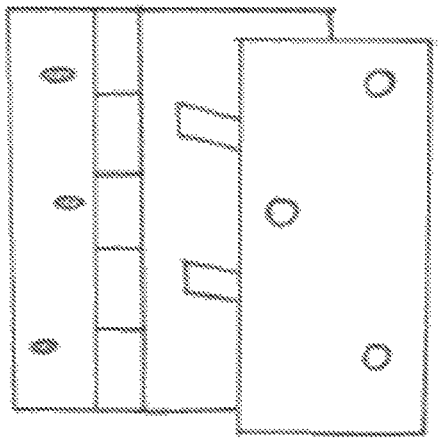
FIG. 5 shows an illustration of another view of the first piece going onto the second part, according to an exemplary embodiment of the invention.
Figure 6:
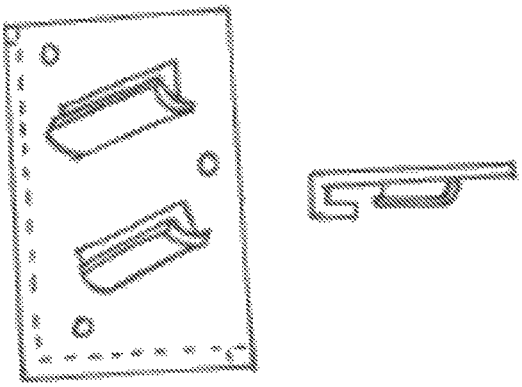
FIG. 6 shows an illustration of the second part, according to an exemplary embodiment of the invention.
Figure 7:
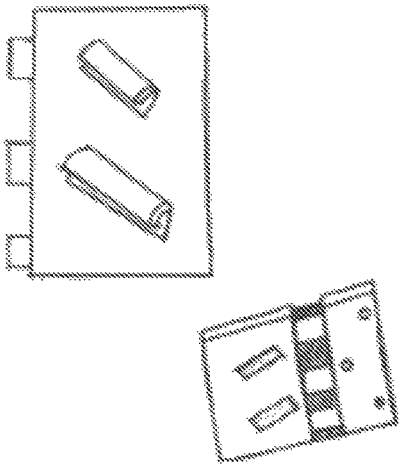
FIGS. 7-8 show illustrations of the first part, according to exemplary embodiments of the invention.
Figure 8:
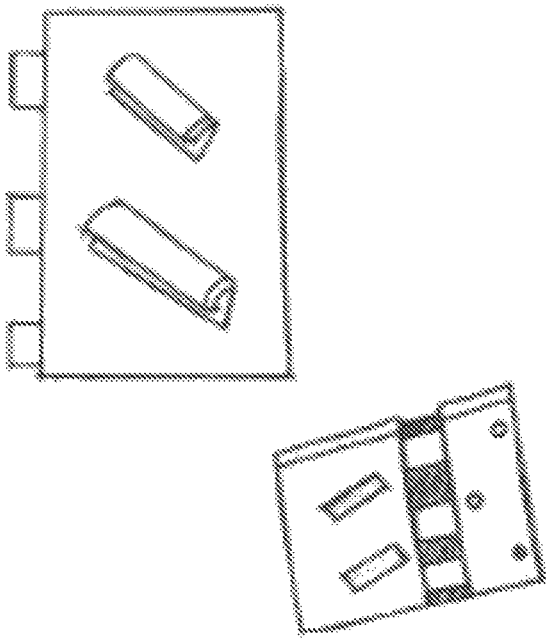
Figure 9:
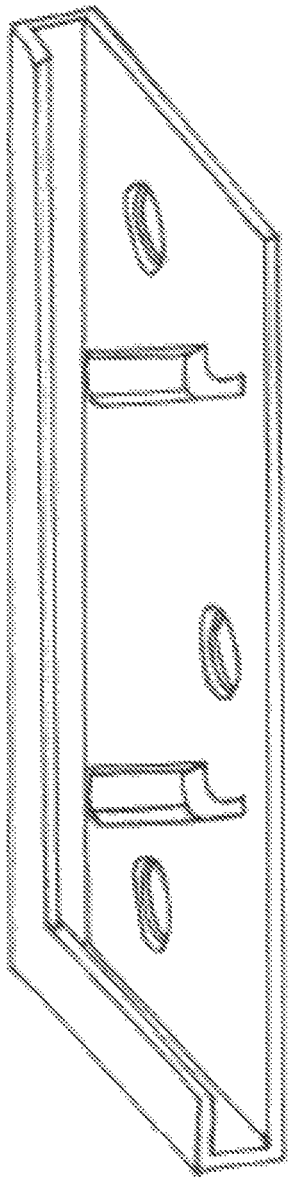
FIG. 9 shows another illustration of the second part, according to an exemplary embodiment of the invention.

Referring to FIGS. 1-2 we see elements of the invention. The hinge structure is split onto two parts, a first part 100 of the hinge structure, whose front view 112 and back view 200 can be seen in an exemplary embodiment. This first part 100 is comprised of a first leaf 102 and a second leaf 104.

In one embodiment, a hinging component 106 joins both of these first and second parts. Said hinging components may be comprised of the traditional knuckle connecting both leaves. The knuckle is the hollow circular part at the joint of a hinge through which a pin is passed. The knuckle is often called a loop, joint, node or curl. In another embodiment, the common end of both leaves form complementary parts of said knuckle. When one or more pins 108 go through the knuckle, both leaves 102/104 act as a hinge. In another embodiment, said hinging components 106 are comprised of flexible metal, plastic or composite strips capable of bending.

Said first leaf 102 of said first part 100 of the hinge structure has one or more openings 110 so that said first leaf 100 may be attached to the door or the door jamb via screws or nails or similar attachment components. The second leaf 104 of said first part 100 has one or more support mechanical components 202 for mating to the second hinge part 300. These mechanical components 202 may be comprised of slots, hooks, awnings, edges, tabs, flaps or similar supports that are mechanically linked to said first part's 100 second leaf 104 so that the weight of the door and/or door assembly can be supported. In one embodiment, these mechanical components 202 are angled, whereas in other they are horizontal.

The second part 300 of the hinge structure 308 is comprised of one or more openings 302 for attachment to the opening of the door or jamb (complementary to where the first part openings 110 are attached), and one or more mechanical components 304 (as with those of the first part 202 comprised of slots, hooks, etc.) that are complementary to those on the first part 202, so that when the second leaf 104 is brought to the second part 300, the mechanical components 202/304 interact with each other and support each other and allow the door supported and open/close on the hinges.

The slide of the mechanical components 202/304 across each other is stopped by the second leaf 104 nesting into the hosting edge 306. In one embodiment this is accomplished by the ends of the edge 306 carrying part of the weight of the door, but in general it is expected that both mechanical components 202/304 and edge 306 (both horizontal and/or vertical) may carry portions of the weight.

In an alternate embodiment, the components 202/302 may have slide control ends, or the second part 300 may have a one or more edge tabs at one end 310 and/or 114 to hold portions of said first hinge structure second leaf 104 nestled within the second part 300. In such cases, in one embodiment, either all or parts of the edge 306 or the ends 114/310 may not be used.

CONCLUSION

In concluding the detailed description, it should be noted that it would be obvious to those skilled in the art that many variations and modifications can be made to the preferred embodiment without substantially departing from the principles of the present invention. Also, such variations and modifications are intended to be included herein within the scope of the present invention as set forth in the appended claims. Further, in the claims hereafter, the structures, materials, acts and equivalents of all means or step-plus function elements are intended to include any structure, materials or acts for performing their cited functions.

It should be emphasized that the above-described embodiments of the present invention, particularly any "preferred embodiments" are merely possible examples of the implementations, merely set forth for a clear understanding of the principles of the invention. Any variations and modifications may be made to the above-described embodiments of the invention without departing substantially from the spirit of the principles of the invention. All such modifications and variations are intended to be included herein within the scope of the disclosure and present invention and protected by the following claims.

The present invention has been described in sufficient detail with a certain degree of particularity. The utilities thereof are appreciated by those skilled in the art. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the foregoing description of embodiments.

The invention claimed is:

1. A hinge structure comprising:

a first and a second part;

wherein said first part is comprised of a first and a second leaf whose common ends have a connecting hinge component, said connecting hinge component defining a vertical axis, said first leaf has one or more through openings, and said second leaf has one or more support mechanical components;

said second part comprised of one or more pieces that has one or more openings and has one or more support mechanical components that are complementary to said one or more support mechanical components on said second leaf of said first part; and said one or more support mechanical components of said first part and said complementary one or more support mechanical components of said second part are each angled at a non-orthogonal and non-parallel angle relative to said vertical axis, such that when said second leaf is attached to said second part, said angle allows said one or more support mechanical components of said first part to slidably engage in a downward direction said complementary one or more support mechanical components of said second part.

2. The hinge structure of claim 1 wherein;

said hinge component is comprised of at least one of the following: knuckle, loop, joint, node, curl and flexible strip; and said support mechanical components are comprised of one or more of the following:

slots, hooks, awnings, flaps, edges, tabs, and flaps.

3. The hinge structure of claim 2 wherein;

said second part has one or more hosting edges to receive therein said second leaf and to stop the sliding of the engaged support mechanical components.

4. The hinge structure of claim 1 wherein;

said second part has one or more hosting edges to receive therein said second leaf and to stop the sliding of the engaged support mechanical components.

* * * * *